United States Patent [19]

Meng et al.

[11] Patent Number: 4,900,222

[45] Date of Patent: Feb. 13, 1990

[54] ROTARY PUMP INLET VELOCITY PROFILE CONTROL DEVICE

[75] Inventors: Sen Y. Meng, Reseda, Calif.; Raymond B. Furst, Vernon, France

[73] Assignee: Rockwell International Corporation, El Segundo, Calif.

[21] Appl. No.: 289,123

[22] Filed: Dec. 23, 1988

[51] Int. Cl.[4] ..... F04D 13/12

[52] U.S. Cl. ..... 415/143; 415/182.1; 415/222; 415/914

[58] Field of Search ..... 415/143, 182.1, 181, 415/914, 218.1, 219.1, 220, 222

[56] References Cited

U.S. PATENT DOCUMENTS

| | | | |
|---|---|---|---|
| 1,762,358 | 6/1930 | Schmidt | 415/222 |
| 2,191,341 | 2/1940 | Curley | 415/222 |
| 2,415,621 | 2/1947 | Arnhym | 415/209 |
| 3,384,022 | 5/1968 | Oshima | 415/143 |
| 4,213,736 | 7/1980 | Gongwer | 415/182 |
| 4,426,190 | 1/1984 | Shapiro et al. | 415/143 |
| 4,642,023 | 2/1987 | Dunn | 415/143 |
| 4,780,050 | 10/1988 | Caine et al. | 415/143 |

OTHER PUBLICATIONS

Scholtz, Norbert, "Aerodynamics of Cascades", an English revised version AGARD, Jul. 1977, p. 213.

Schlichting, H., "Boundary-Layer Theory", copy May. 1979, by McGraw-Hill, Inc.

S.A.E. Aerospace Applied Thermodynamics Manual, Second Edition, Jun. 1969, p. 3, "Incompressible Fluid Flow".

*Primary Examiner*—Robert E. Garrett

*Assistant Examiner*—John T. Kwon

*Attorney, Agent, or Firm*—H. Fredrick Hamann; Harry B. Field; David C. Faulkner

[57] ABSTRACT

A rotary pump with an inlet flow duct having a convergent section upstream the tips of the rotor blades. The convergent section decreases the cross-sectional flow area of the inlet flow duct prior to the flow being introduced into the rotor, thereby creating a substantially uniform velocity profile in the flow just upstream the rotor blades.

2 Claims, 4 Drawing Sheets

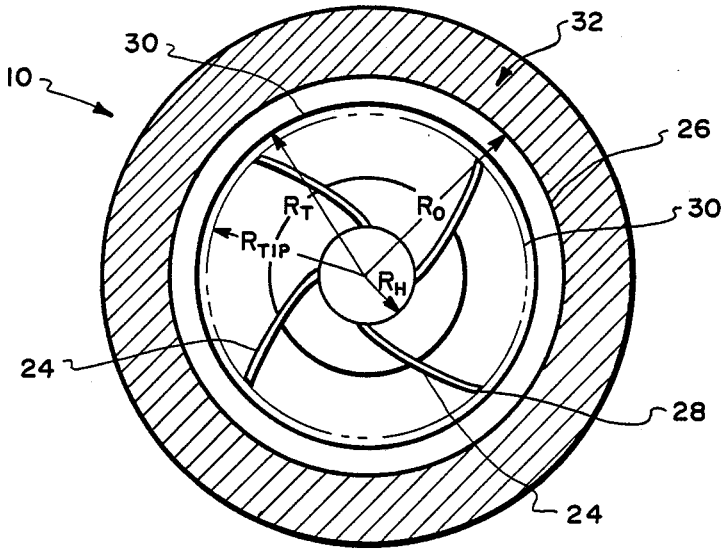
Fig. 2.
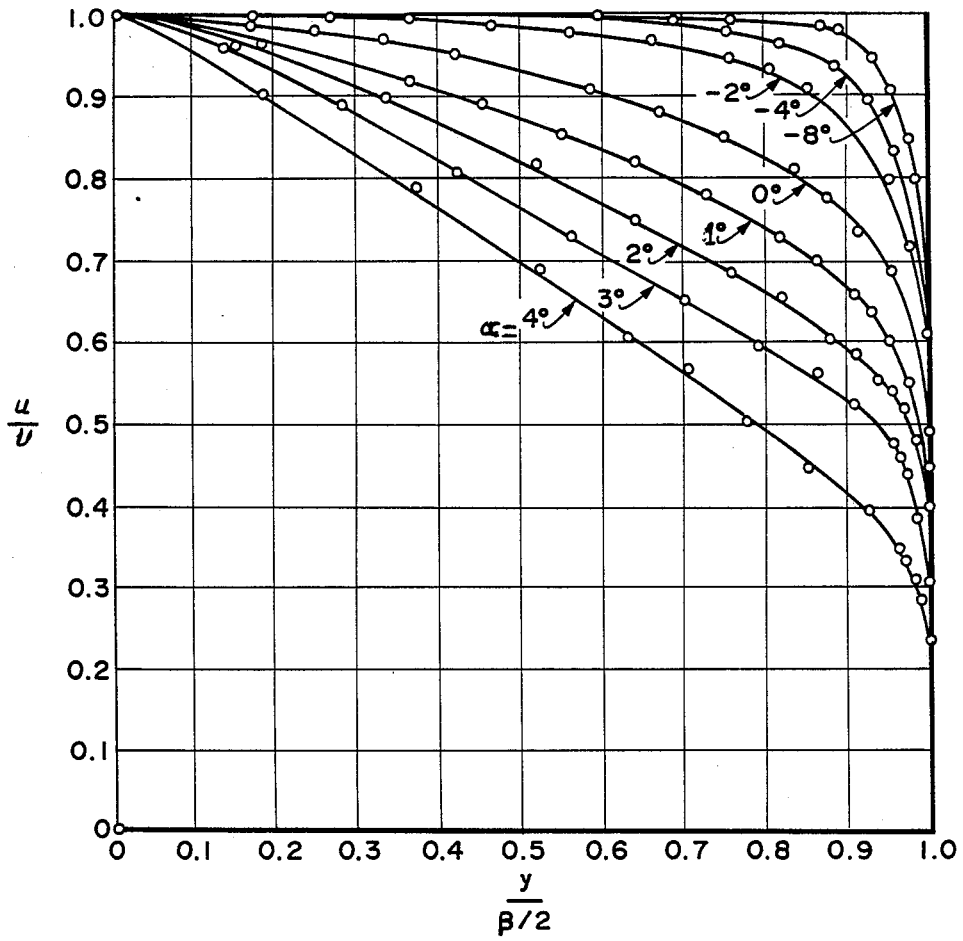
Fig. 3. VELOCITY DISTRIBUTION IN CONVERGENT AND DIVERGENT CHANNELS WITH FLAT WALLS

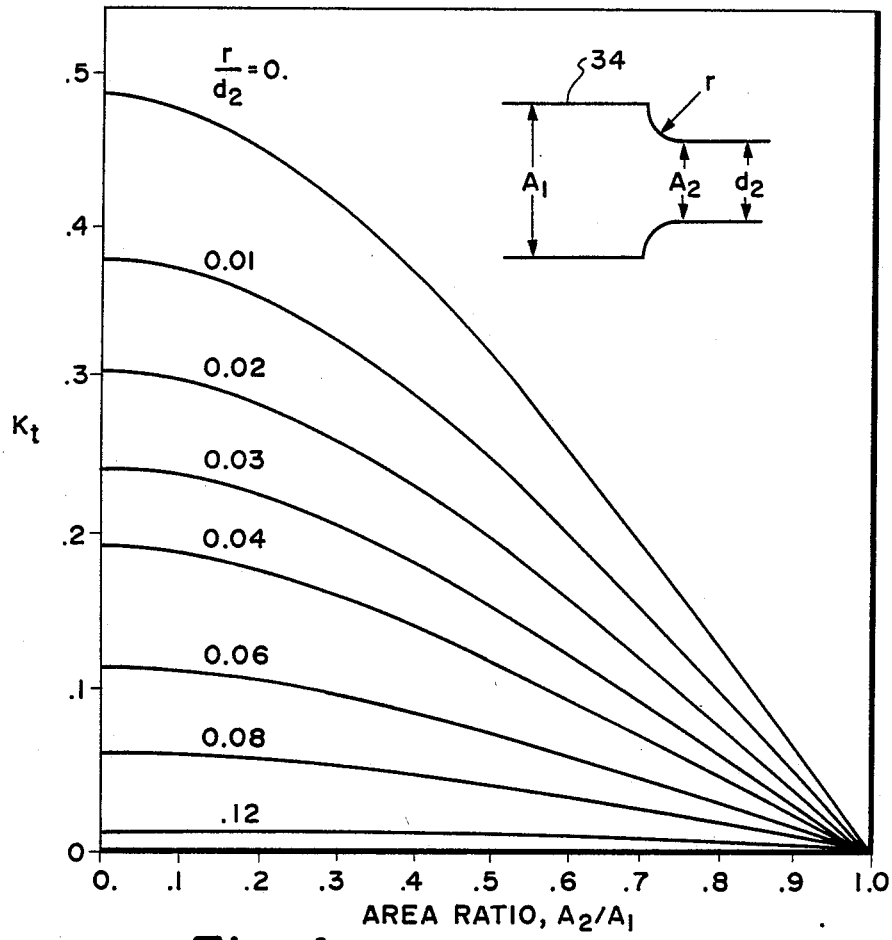
Fig. 4. PRESSURE LOSSES OF CONTRACTION PIPE
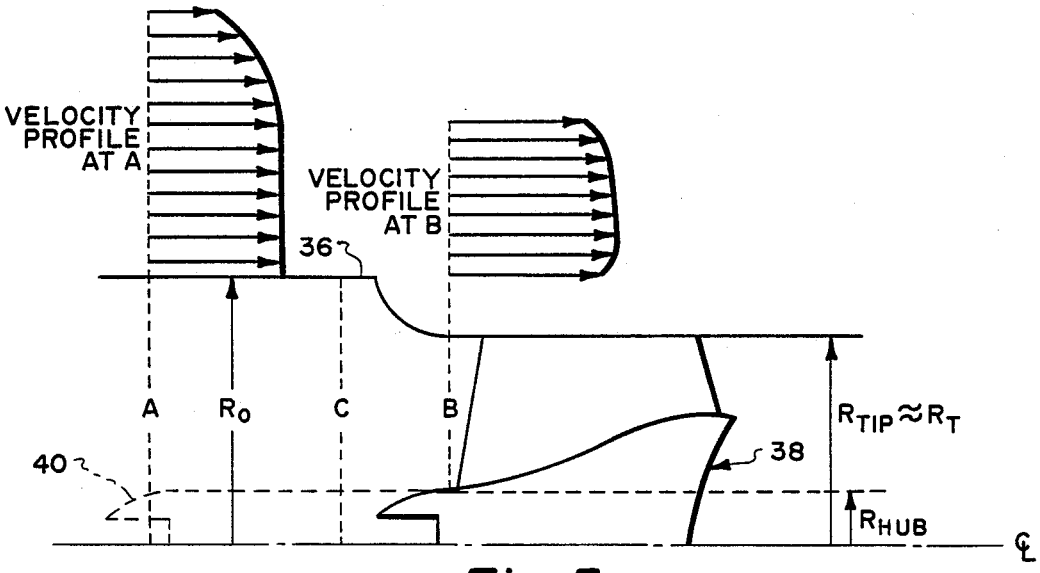
Fig. 5.

ROTARY PUMP INLET VELOCITY PROFILE CONTROL DEVICE

BACKGROUND OF THE INVENTION

1. Field of the Invention

The present invention relates to improvements in rotary pumps, and particularly to increasing the performance of rotary pumps by modifying the velocity profile upstream of the rotor.

2. Description of the Prior Art

The design procedure for most prior art rotary pumps is based on the assumption of a uniform pump inlet velocity from rotor hub to tip. Unfortunately however, the inlet velocity profile in conventional rotary pumps is not uniform. A non-uniform pump inlet velocity results, in part, from the boundary layer and in part from the cascade induced incidence (CII) effect angle. (See, for example, Scholz, Norbert, "Aerodynamics of Cascades", an English revised version AGARD 1977, pg. 211.)

The typically designed inducer leading edge hub-tip blade angle distribution may be represented by the equation:

$R \cdot \tan \beta = \text{constant}$, where $R$ = radius at a location between the hub and the tip $\beta$ = blade angle corresponding to R In actual non-uniform flow, when a blade is constructed in accordance with the above equation, the tip will experience a higher incidence angle than predicted. The hub will have a much lower incidence angle than predicted. Therefore, conventional design procedures result in reduced pump suction capability and pump efficiency.

OBJECTS AND SUMMARY OF THE INVENTION

The principal object of the present invention therefore is to provide a rotary pump which is highly efficient and low in cost.

Other objects, advantages and novel features of the present invention will become apparent from the following detailed description of the invention when considered in conjunction with the accompanying drawing.

These objects are achieved by providing an inlet duct to the rotary pump which is convergent just upstream the rotor blades. The convergent inlet flow duct has a geometry defined by the relationship:

$$R_o = R_T\left\{\frac{(n+1)(2n+1)}{2n^2}\cdot\frac{(1-\sigma^2)}{K}+\sigma^2\right\}^{\frac{1}{2}}, \text{ where}$$

$n=2$ where $Re \leqq 2300$ $n=2+0.00432\ (Re-2300)$ where $2300<Re<3200$, and $n=3Re^{1/12}$ where $Re \geqq 3200$ $\sigma = R_{HUB}/R_T$, and $0.8 \leqq K \leqq 1$ By utilizing a convergent inlet duct as defined in the above relationship, the boundary layer flow and the unique geometry ($R \cdot \tan \beta = \text{constant}$) of the rotor including the rotor blades is compensated for. The convergent duct results in fluid having a substantially uniform velocity profile being introduced into the rotor blades.

BRIEF DESCRIPTION OF THE DRAWINGS

FIG. 2 is an end view of the rotary pump taken along line 2—2 of FIG. 1.

FIG. 3 is a graph which illustrates the velocity distribution in convergent and divergent channels with flat walls.

FIG. 4 is a graph which illustrates pressure looses within a contraction pipe.

FIG. 5 shows a model of a rotary pump embodying the principles of the present invention useful for theoretical consideration.

The same elements or parts throughout the figures are designated by the same reference characters.

DETAILED DESCRIPTION OF THE INVENTION

Figure 1:
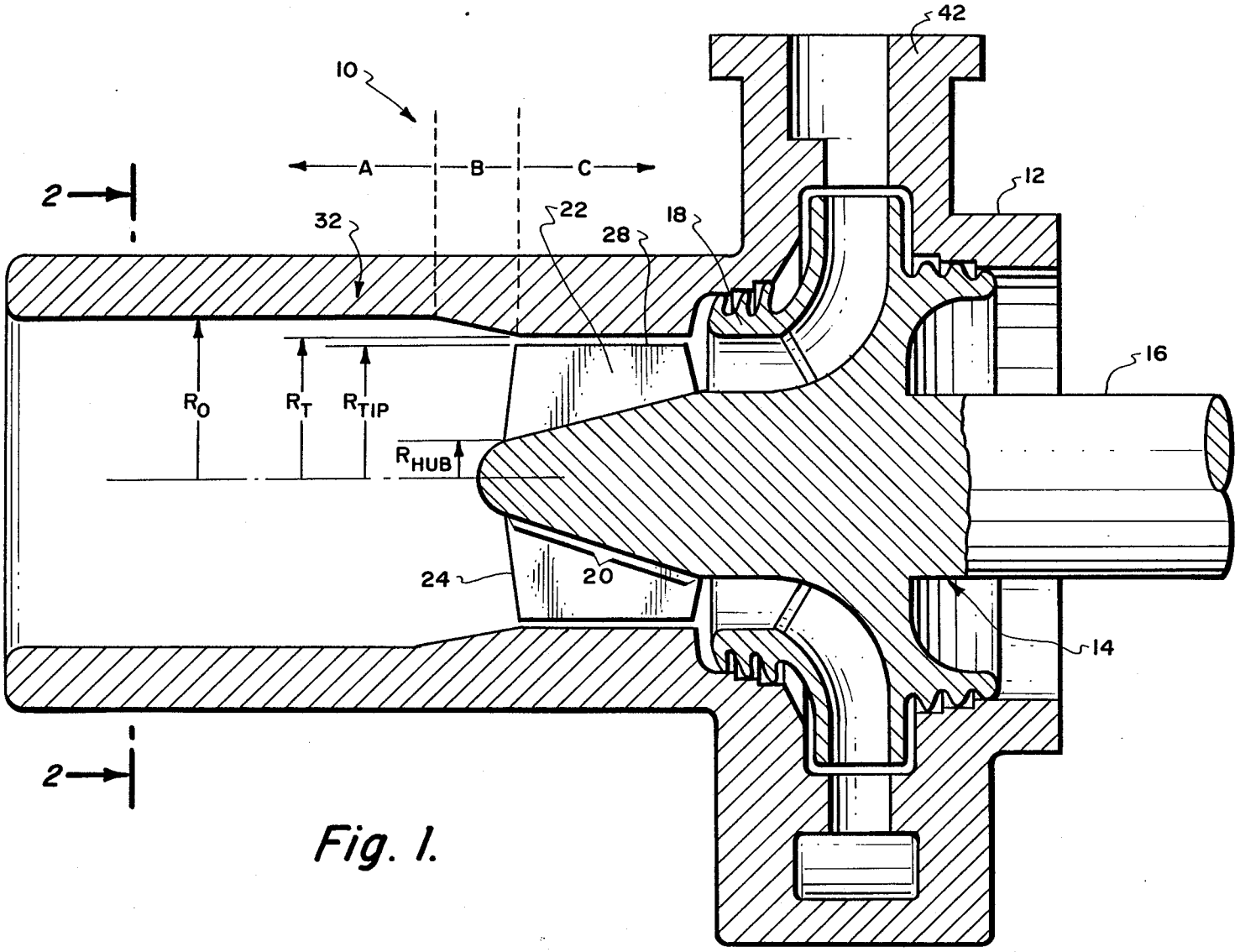
FIG. 1 is a schematic side view, in partial cross section, of a preferred embodiment of the present invention showing an inducer/impeller rotary pump.

Referring to FIG. 1, a preferred embodiment of the present invention is depicted comprising elements of a rotary pump 10 constructed in accordance with the present invention. The pump includes a housing 12 containing a rotatable rotor generally designated 14 provided with a shaft 16 and impeller 18.

The rotor 14 has an upstream end with a hub surface 20 of revolution thereon. A plurality of rotor blades 22 extend radially from hub surface 20. The portion of the rotary pump 10 which contains hub surface 20 and blades 22 is commonly referred to as the inducer. However, as explained below with relation to other embodiments a rotary pump embodying the principles of the present invention does not necessarily require an inducer. Thus, to prevent any ambiguities in the claim language below, the inducer blades are described herein generally as rotor blades. Each rotor blade 22 has a leading edge 24. The blades 22 are axially aligned. Thus, a circle 26 with a radius $R_{HUB}$ is formed, defined by the intersection of each leading edge 24 with the hub surface 20. (See FIG. 2) ($R_{HUB}$ is known in the art as the leading edge hub radius.) Each rotor blade 22 terminates in a tip 28. The tips 28 define a second circle 30 having a radius $R_{TIP}$.

The inlet flow duct to the rotary pump 10 is designated generally as 32. A first section, labeled A, upstream the rotor 14 has a substantially constant radius $R_o$. A second section, B, downstream the first section, A, but upstream the blade tip 28 is convergent. A third section, C, downstream the second section has a radius $R_T$ which is slightly larger than $R_{TIP}$ (i.e. sufficient to provide clearance for the tips 28). The flow duct 32 has a geometry defined by the relationship, $$R_o = R_T\left\{\frac{(n+1)(2n+1)}{2n^2}\cdot\frac{(1-\sigma^2)}{K}+\sigma^2\right\}^{\frac{1}{2}}, \text{ where} \quad (1)$$

$n=2$ where $Re \leqq 2300$ $n=2+0.00432\ (Re-2300)$ where $2300<Re<3200$, and $n=3Re^{1/12}$ where $Re \geqq 3200$ $\sigma=R_{HUB}/R_T$, and $0.8 \leqq K \leqq 1$ Equation 1 is derived from the following theoretical considerations:

The literature demonstrates that the boundary layer in a convergent duct is much thinner than a divergent or constant area duct. FIG. 3 is a graph excerpted from Schlichting, H., "Boundary-Layer Theory", 1979, published by McGraw-Hill, Inc., pg. 669. The graph illustrates the velocity distribution in convergent ducts, divergent ducts and constant area ducts.

The abscissa corresponds to the locations from the center of the duct in dimensionless units, where:

y=distance from the center of the duct

B=diameter of the duct

The ordinate corresponds to velocity in dimensionless units, where:

n=local velocity

U=maximum velocity (i.e. at the center of the pipe)

The curves represent the velocity distribution for ducts with half-cone (included) angles, $\alpha$ between $-8°$ and 4°, where the negative sign represents a convergent duct. As can be seen from the illustration, the boundary layer becomes very thin with convergent ducts. Therefore, if a convergent duct is utilized just upstream the rotor blades, the inlet velocity distribution will be substantially uniform and the leading edge blade angle distribution from hub to tip, $R \cdot \tan \beta$, will be accurate. The $R \cdot \tan \beta$ blade designed for a uniform velocity distribution is simple to describe and easier to fabricate than the complex shapes required to match a non-uniform velocity profile. Without a convergent inlet, the rotor leading edge blade, in order to optimize performance, would have to be complicated and difficult to fabricate.

A question regarding possible extra losses by the use of a convergent pipe may be raised. However, further reference to the literature indicates that the losses would be relatively small for a convergent duct. The graph of FIG. 4 illustrates the pressure losses given the model designated 34 in that Figure. (This Figure is excerpted from S.A.E. Aerospace Applied Thermodynamics Manual, Second Edition, 1969, page 19.) Although FIG. 4 assumes a pipe converging by a radius R, the model provides an approximation as to the worst possible pressure loss that might result from the convergence of the subject inlet duct. For applicants' anticipated purposes, the subject inlet duct has a ratio of $r/d_2<0.12$, thus $K_t$ is less than 3% of the exit velocity head. This pressure loss is more than compensated for by the benefits of the matched design.

A schematic illustration of a convergent duct 36 in front of a rotor 38 is shown in FIG. 5. In view of the above discussion, it is assumed that the total pressure losses due to the duct contraction are minimal (i.e. applicant's inlet duct would have a curvature which is less than the abruptness created by a radius of a circle, which was the assumption made above relating to FIG. 4).

Assuming that the velocity is constant at Section B (i.e. the boundary layer is negligible), then $$\overline{U}_B=Q/A \tag{2}$$

where, Q=flow rate, $\overline{U}_B$=blade leading edge velocity, and $$A=\pi(R_T^2-R_{HUB}^2) \tag{3}$$

$$\text{Therefore, } U_B = \frac{Q}{\pi\left[1-\frac{R_{HUB}^2}{R_T^2}\right]\cdot R_T^2} \tag{4}$$

If $\sigma=R_{HUB}/R_{TIP}$ is substituted into Equation 4; then $$U_B = \frac{Q}{\pi(1-\sigma^2)R_T^2} \tag{5}$$

(It is assumed that for the purposes of this equation $T_T \simeq R_{TIP}$.)

The fully developed pipe flow profile, as defined in Schlichting, H., "Boundary-Layer Theory", 1979, by McGraw-Hill, Inc., pg. 559 is:

$$\frac{U_A}{U_{MAX}} = \frac{2n^2}{(n+1)(2n+1)}, \tag{6}$$

where:

$n=2$ where $Re \leqq 2300$, $n=2+0.00432\ (Re-2300)$ where $2300<Re<3200$, and $n=3Re^{1/12}$ where $Re>3200$;

$\overline{U}_A$=average velocity at section A; and $U_{MAX}=K\overline{U}$.

Studies by applicants conclude that $0.8 \leqq K \leqq 1$ allows attainment of a reasonably uniform inducer leading edge profile.

Solving Equations 5 and 6 for $R_o$ results in the following relationship:

$$R_o = R_T\left\{\frac{(n+1)(2n+1)}{2n^2}\cdot\frac{(1-\sigma^2)}{K}\right\}^{\frac{1}{2}}. \tag{7}$$

In some instances the rotor may actually protrude into Section A as shown by phantom lines 40. Conservative design practices would include such a presumption. Therefore, the resulting workable equation is that labeled above as Equation 1.

Utilizing a convergent inlet duct provides an expedient manner of modifying the velocity profile upstream of the blade tips into a uniform flow thereby allowing a simple rotor blade hub-to-tip blade angle distribution to match the flow. The simple blading reduces rotor fabrication cost. The better flow match improves pump suction performance and pump operating life. Studies by applicants demonstrate that suction capability improves up to 20% and efficiency up to 5% by utilization of the subject inlet duct.

Referring back to FIG. 1, in operation, torque is applied to rotor 14 from an external power source (not shown). A fluid is introduced through the convergent section B of inlet duct 32. The velocity profile is made substantially uniform by decreasing the boundary layer. The flow then proceeds between the inducer blade 22 of the inducer and then through the impeller 18. The flow is then discharged radially through an exit duct 42.

As noted above it is to be understood that this invention is not limited to the inducer/impeller, combination of the above described embodiment, although such an arrangement is desirable for high suction performance and high discharge pressure applications.

Figure 6:
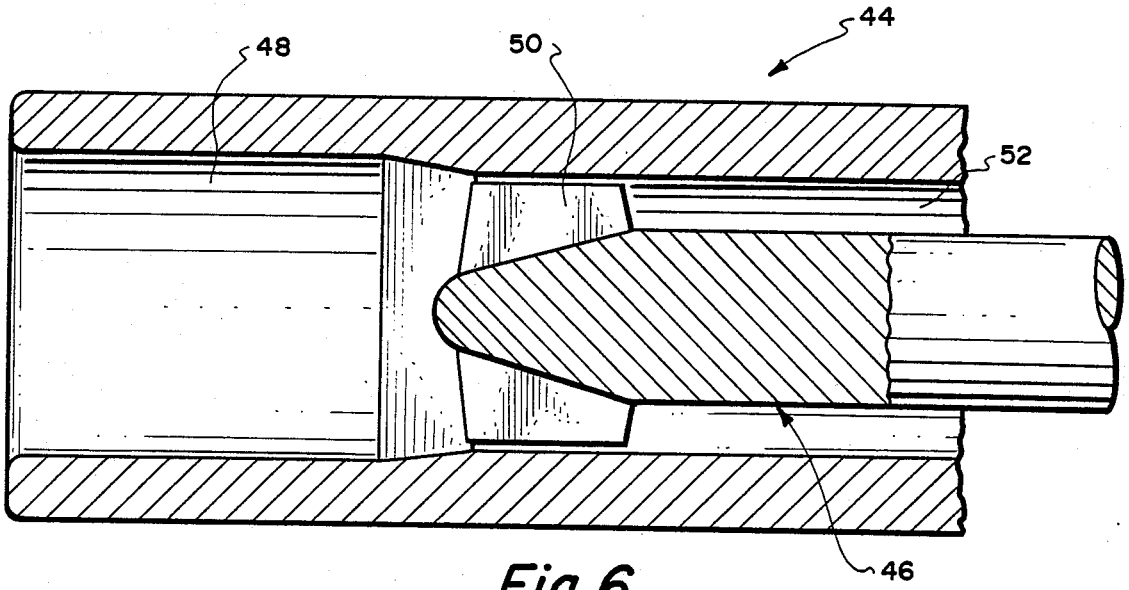
FIG. 6 is a schematic side view, in partial cross section, of a preferred embodiment of the present invention including a rotary pump having an inducer.

FIG. 6 illustrates a rotary pump 44 which includes a rotor/inducer generally designated 46 and is absent the impeller found in the previous embodiment. The embodiment of FIG. 6 is desirable for high suction performance and low discharge pressure applications. Fluid flows through the convergent inlet duct 48 which produces a uniform velocity profile in the fluid therein. The fluid then flows through the inducer/rotor blades 50 and finally exits axially through the exit duct 52.

Figure 7:
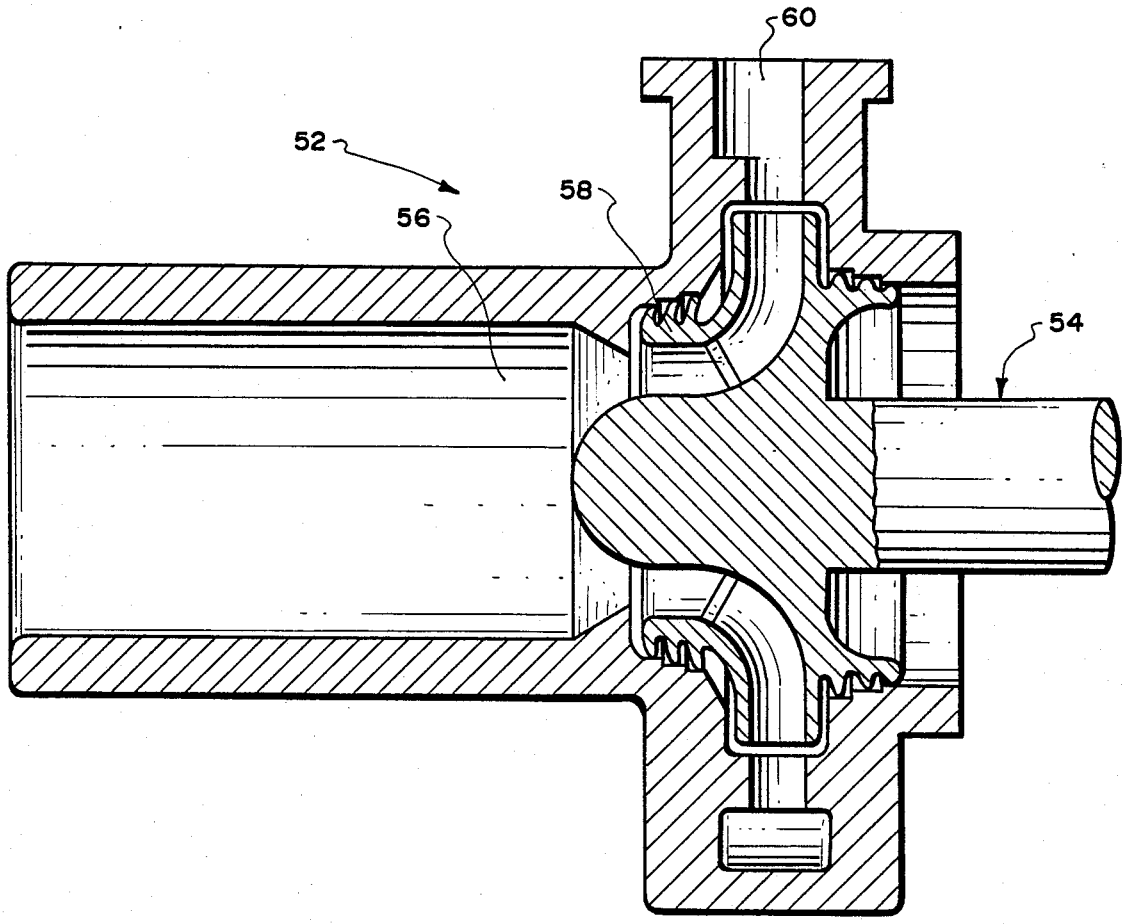
FIG. 7 is a schematic view, in partial cross section, of a preferred embodiment of the present invention including a rotary pump having an impeller.

FIG. 7 illustrates a rotary pump 52 which includes a rotor/impeller 54 and is absent the inducer found in either of the previous embodiments. The embodiment of FIG. 7 is desirable for high discharge pressure/low suction performance applications. Fluid flows through the convergent inlet duct 56 through the impeller blades 58 and radially out the exit duct 60.

Obviously, many modifications and variations of the present invention are possible in light of the above teachings. It is therefore to be understood that, within the scope of the appended claims, the invention may be practiced otherwise than as specifically described.

For example, in FIGS. 1, 6 and 7, the convergency in the inlet duct is shown to be linearly tapered. However, the duct may be smoothly curved in various fashions as long as the $R_o$ is as prescribed in the above equations in order to provide a substantially constant velocity profile.

What is claimed and desired to be secured by Letters Patent of the United States is:

1. A rotary pump, comprising:

a housing;

a rotor rotatably attached to said housing having an upstream end with a hub surface of revolution thereon;

a plurality of rotor blades extending radially from said hub surface, each rotor blade having a leading edge, each leading edge intersecting said hub surface at substantially the same axial position, said intersections defining a first circle with a radius being the leading edge hub radius, $R_{HUB}$, each rotor blade terminating in a tip, said tips defining a second circle having a radius, $R_{TIP}$, and a flow duct attached to said housing for introducing flow into said rotor, said flow duct having a first section upstream said rotor with a substantially constant radius, $R_o$, a convergent second section downstream said first section but upstream said tips, and a third section downstream said second section having a radius $R_T$ being approximately equal to $R_{TIP}$, said flow duct having a geometry defined by the relationship, $$R_o = R_T\left\{\frac{(n+1)(2n+1)}{2n^2}\cdot\frac{(1-\sigma^2)}{K}+\sigma^2\right\}^{\frac{1}{2}}, \text{ where}$$

$n=2$ where $Re \leqq 2300$, $n=2+0.00432\ (Re-2300)$ where $2300<Re<3200$, and $n=3Re^{1/12}$ where $Re>3200$;

$\sigma=R_{HUB}/R_T$; and, $0.8 \leqq K \leqq 1$.

2. A rotary pump, comprising:

a housing;

a rotor rotatably attached to said housing having an upstream end with a hub surface of revolution thereon;

a plurality of rotor blades extending radially from said hub surface, each rotor blade having a leading edge and each terminating in a tip, each leading edge intersects said hub surface at substantially the same axial position, said intersection defining a first circle with a radius being the leading edge hub radius, $R_{HUB}$, said tips defining a second circle having a radius, $R_{TIP}$; and inlet flow duct means attached to said housing for introducing flow into said rotor, said inlet flow duct means having a convergence section upstream said tips with a substantially constant radius, $R_O$, a convergence section downstream said first section but upstream said tips, and a third section downstream said second section having a radius, $R_t$ being approximately equal to $R_{TIP}$, said flow duct having a geometry defined by the relationship, $$R_o = R_T\left\{\frac{(n+1)(2n+1)}{2n^2}\cdot\frac{(1-\sigma^2)}{K}\right\}^{\frac{1}{2}} \text{ where}$$

$n=2$ where $Re \leqq 2300$, $n=2+0.00432\ (Re-2300)$ where $2300<Re<3200$, and $n+3Re^{1/12}$ where $Re>3200$;

$\sigma=R_{HUB}/R_T$; and, $0.8 \leqq K \leqq 1$.

* * * * *